US005934031A

United States Patent [19]

deNormand

[11] Patent Number: 5,934,031

[45] Date of Patent: Aug. 10, 1999

[54] JAMB LINER WIND BRACES FOR TILT WINDOW

[75] Inventor: Richard S. deNormand, Rochester, N.Y.

[73] Assignee: Caldwell Manufacturing Company, Rochester, N.Y.

[21] Appl. No.: 09/072,039

[22] Filed: May 4, 1998

[51] Int. Cl.[6] ..... E06B 3/00; E05D 13/00

[52] U.S. Cl. ..... 52/204.5; 52/204.1; 52/204.7; 49/453; 49/456; 49/435

[58] Field of Search ..... 52/204.1, 204.7, 52/210; 49/458, 428, 431, 434, 435, 453, 456

[56] References Cited

U.S. PATENT DOCUMENTS

| | | | |
|---|---|---|---|
| 1,542,786 | 6/1925 | Fromhold | 49/435 X |
| 1,658,317 | 2/1928 | Wight et al. . | |
| 1,769,581 | 7/1930 | Kilberg . | |
| 1,842,242 | 1/1932 | Bolles . | |
| 2,100,556 | 11/1937 | Van Fleet . | |
| 2,511,341 | 6/1950 | Johnson . | |
| 2,778,068 | 1/1957 | Kaufman et al. . | |
| 3,010,163 | 11/1961 | Osten, Sr. . | |
| 3,054,152 | 9/1962 | Trammell, Jr. . | |
| 3,116,520 | 1/1964 | MacGregor . | |
| 3,280,511 | 10/1966 | Johnson . | |
| 3,325,945 | 6/1967 | Beasley, Jr. et al. . | |
| 3,797,168 | 3/1974 | Trout | 49/453 X |
| 4,583,639 | 4/1986 | Fedick et al. . | |
| 4,726,148 | 2/1988 | Tix . | |
| 4,885,871 | 12/1989 | Wesfall et al. | 49/453 X |
| 5,544,450 | 8/1996 | Schmidt et al. | 49/453 X |
| 5,546,702 | 8/1996 | deNormand et al. . | |
| 5,551,189 | 9/1996 | Westfall . | |
| 5,657,579 | 8/1997 | Bruchu et al. | 49/181 X |

*Primary Examiner*—Christopher T. Kent
*Assistant Examiner*—Brian E. Glessner
*Attorney, Agent, or Firm*—Eugene Stephens & Associates

[57] ABSTRACT

Wind resistance of a window mounting tilt sash between a pair of jamb liners is increased by braces that attach to frame sides of the jamb liners at the check rail region of the window. The braces have a profile that fits a frame side profile of the jamb liners, including brace channels that receive and support shoe channels of the jamb liners. The braces help the jamb liners resist deformation in response to wind force and significantly increase the wind resistance of the window.

35 Claims, 3 Drawing Sheets

JAMB LINER WIND BRACES FOR TILT WINDOW

TECHNICAL FIELD

Tilt sash windows supporting counterbalanced sash between jamb liners within window frames.

BACKGROUND

Windows that support one or two tilt sash between jamb liners within a window frame are both popular and inexpensive, but they are less wind resistant than is desirable in regions subject to hurricanes. The sash must be free to tilt, which offers the users a highly desirable convenience, and the jamb liners must be resiliently mounted to seal against the sash and allow the sash to tilt; but this combination of requirements makes high wind resistance of the window difficult to achieve.

Several suggestions have been made to enhance the wind resistance of window sash supported between jamb liners, including the suggestions in U.S. Pat. Nos. 5,546,702 and 5,551,189. Pressure from the insurance industry for more wind resistant windows, along with more stringent building code requirements for wind resistance, have set standards that exceed the window strength attainable from such suggestions so that further improvement is needed.

SUMMARY OF THE INVENTION

Many experiments testing windows under wind pressure to identify weaknesses in tilt sash windows and to evaluate different window strengthening measures have led to a simple, effective, and inexpensive improvement that greatly increases window resistance to wind pressure. The improvement occurs in regions of tilt sash windows identified by experimentation as weak spots contributing to window failure under wind load. The improvement strengthens the weak regions by adding a pair of braces that attach to frame sides of the jamb liners and stiffen the jamb liners against deformation in response to wind force applied to the sash and transmitted via sash pins to sash shoes in the jamb liners. The braces are preferably formed of metal extrusions configured to fit a frame side profile of the jamb liners and to attach to the jamb liners in a check rail region of the window. The braces are not attached to the window frame and can be separated from the window frame by resilient material arranged between the jamb liners and the window frame.

Wind force applied to a window sash can be either positive, tending to push the window into the building, or negative, tending to pull the window out of the building. Both positive and negative wind force urges a sash respectively inward or outward, which in turn urges sash carrier shoes and jamb liner carrier channels inward or outward. The braces help the jamb liners resist inward and outward movements and especially hold the jamb liners against collapsing on themselves in response to the force of inward or outward movements. The braces also hold shoe channels of the jamb liners against deformation that could otherwise allow sash shoes to twist within their shoe channels in response to wind force transmitted to the shoes via sash pins. Any such twisting of the sash shoes within their shoe channels could release the sash pins from the shoes and cause catastrophic window failure.

DRAWINGS

DETAILED DESCRIPTION

This invention arose from experimentation with the wind resistance of tilt sash windows supported in jamb liners within a window frame. Such windows are typically made of wood and are held in wooden frames, with flexible resin jamb liners interposed between the tilt sash and the window frame. Many experiments applied wind force to such windows until they shattered, and the experiments were designed to identify the weakest regions of the windows and to explore ways of strengthening such weak regions.

These experiments have shown that the weakest region of such tilt sash, jamb liner windows is the check rail region where the top rail of a lower sash overlaps a bottom rail of an upper sash. The check rail region is often midway between the top and bottom of the window and often includes a sweep lock that can lock the sash rails together. For testing purposes, sash check rails are locked together by a sweep lock. The top rail of the upper sash is supported by a bead, and the bottom rail of the lower sash is supported by a window sill; but at the check rail region, the sash rails support each other and are weak in wind resistance.

The top rail of the lower sash overlaps the bottom rail of the upper sash on the inside of the window so that positive wind force pushes the bottom rail of the top sash inward against the top rail of the bottom sash. Sash pins connect the bottom rail of the top sash to sash carrier shoes that run in carrier channels of jamb liners; and when the sash are closed and locked, the top sash shoes are disposed at the check rail level. Experiments have shown that positive wind force applied to tilt sash transmits through the sash pins for the top sash to the shoes for the top sash and to the jamb liners supporting both sash within the window frame. Positive wind force can cause the sash, the check rails, and the jamb liners to deflect inward at the check rail level, enough to shatter the window in a catastrophic failure.

Negative wind force has a similar effect by pressing both sash outward. Negative force on the bottom sash presses outward at the check rail level, where the carrier shoes of the top sash are held within a jamb liner carrier channel for the top sash. Negative wind force thus urges both sash and the jamb liners outward. The bottom rail of the bottom sash is also urged outward by negative force, at a sill region of the window. The top rail of the upper sash is held against negative wind force by a bead within the window frame, but such a bead is not practical at the sill region of the window where water must drain outward from the bottom rail of the bottom sash. This leaves the sill region of the bottom sash vulnerable to negative wind force.

Figure 1:
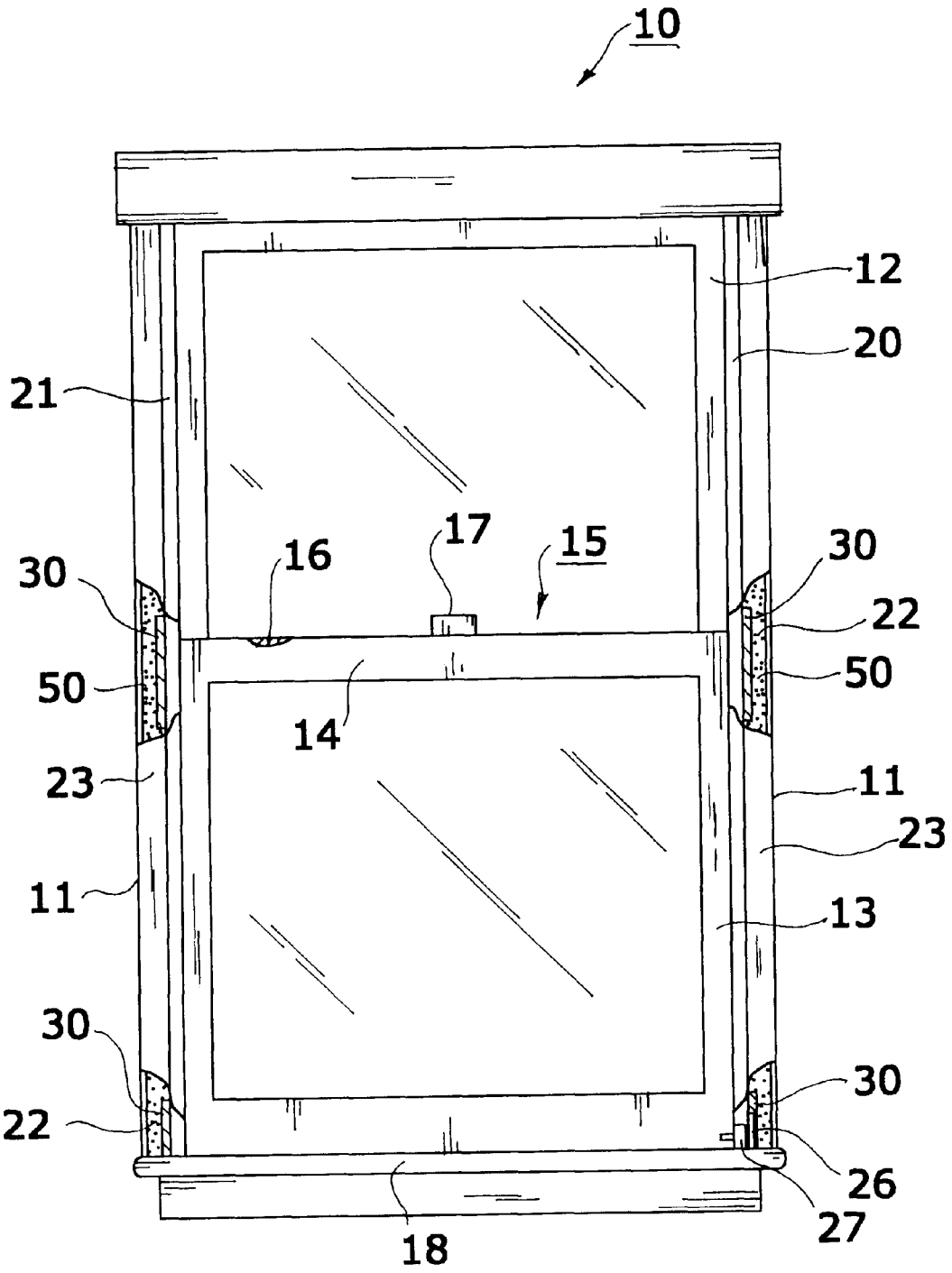
FIG. 1 is a partially schematic and partially cutaway elevational view of a window equipped with the inventive wind resistance blocks.

The window 10 of FIG. 1, viewed from inside, schematically illustrates how wind resistant braces 30 can be deployed according to the invention to increase the wind resistance of tilt sash. Within frame 11 of window 10 are an upper tilt sash 12 and a lower tilt sash 13 having overlapping rails at check rail region 15, where upper rail 14 of lower sash 13 is locked to lower rail 16 of upper sash 12 by a sweep lock 17.

Although it is commonplace that both sash 12 and 13 be tilt sash, this is not necessary. It is also possible for one of the sash (usually an upper sash) to be fixed while the other sash is movable and tiltable.

Tilt sash 12 and 13 are supported within frame 11 by flexible jamb liners 20 and 21 that resiliently engage stile edges of the sash for sealing the window while allowing the sash to move up and down and to tilt. Resilient material such as a foamed resin 22 is preferably disposed between jamb liners 20 and 21 and frame 11 to resiliently bias the jamb liners into engagement with the stiles of tilt sash 12 and 13.

Figure 2:
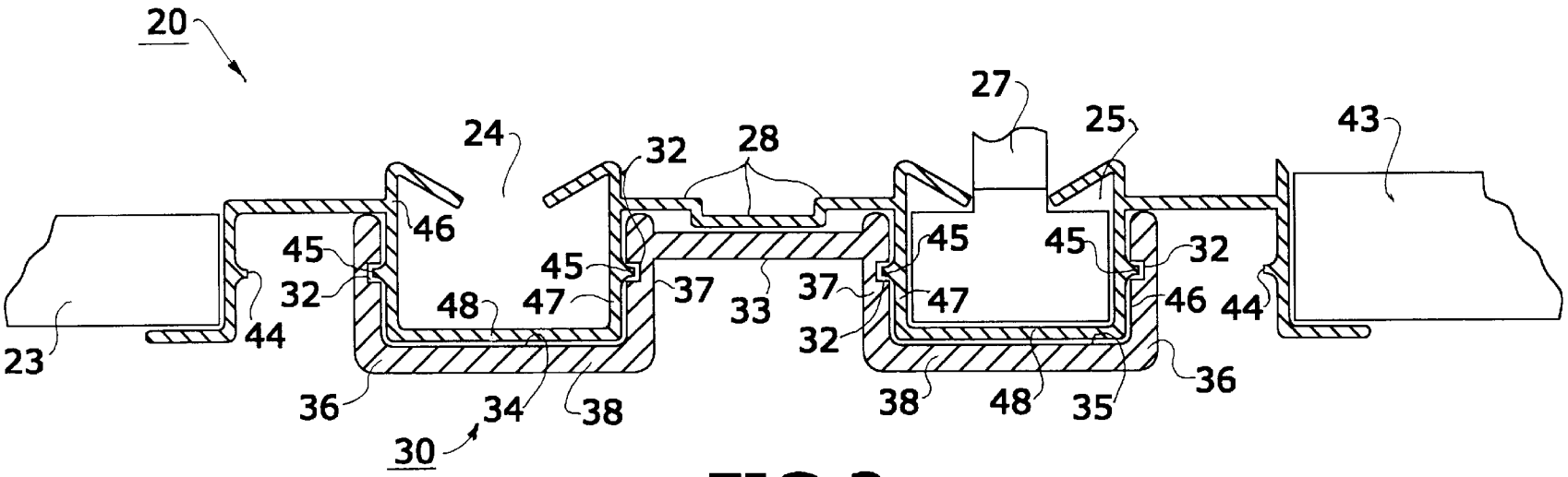
FIG. 2 is a partially schematic, end elevational view of a jamb liner provided with a brace according to the invention.
Figure 3:
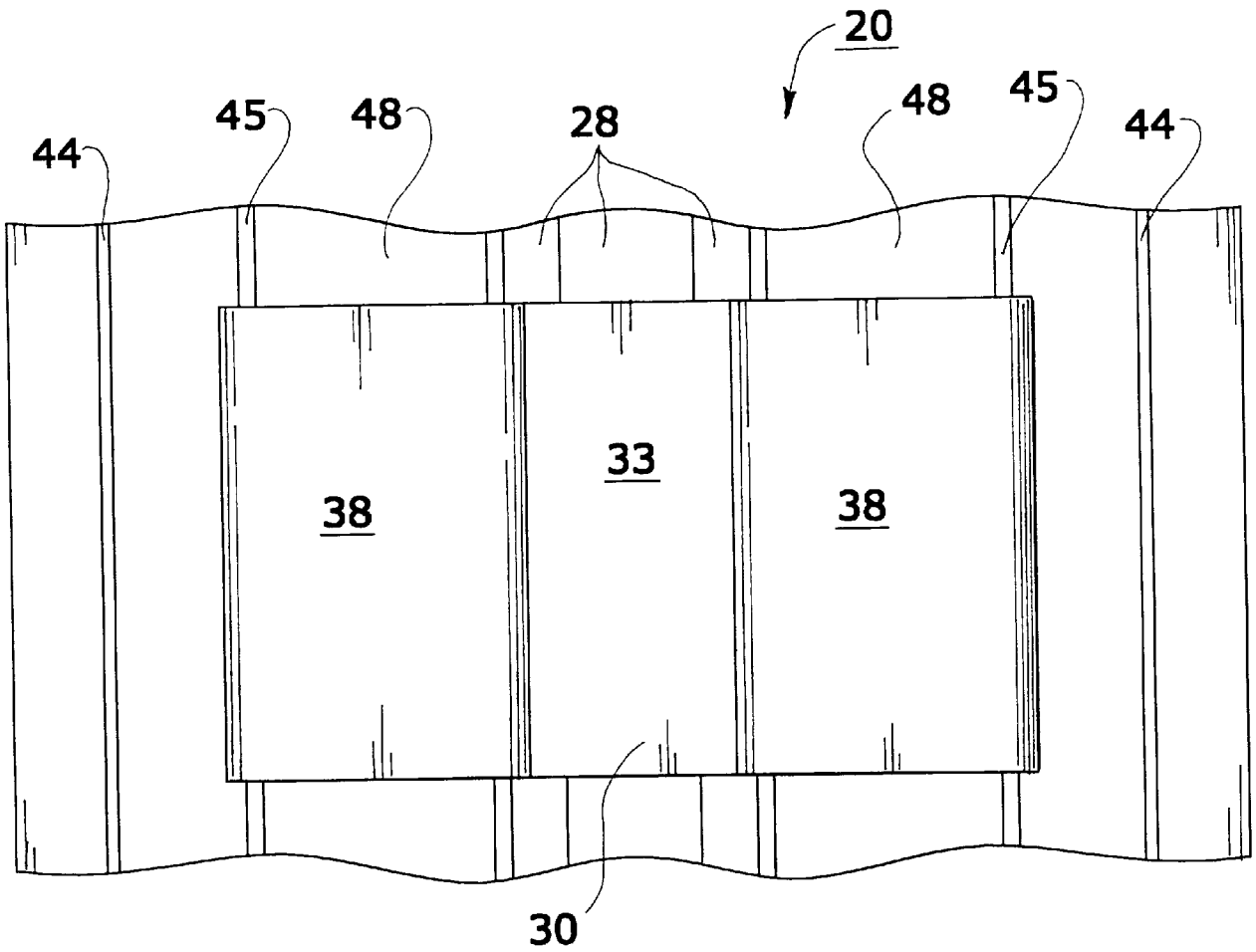
FIG. 3 is a fragmentary and partially schematic, elevational view of a rear profile of a jamb liner braced according to the invention.

To strengthen the wind resistance of window 10, braces 30 are formed to fit and be mounted on a rear or frame side profile of each of the jamb liners 20 and 21 in check rail region 15, as best shown in FIG. 2. Jamb liner 20 is normally formed of an extrusion of polyvinyl chloride to fit between an outer trim strip 43 and an inner trim strip 23. Each of the jamb liners 20 and 21 are preferably identical, and each includes a pair of carrier shoe channels 24 and 25 in which sash carrier shoes 26 run vertically. Sash pins 27 connect each of the tilt sash to a respective carrier shoe 26, and this connection transmits wind force from the tilt sash to the jamb liners.

Brace 30 is preferably formed of a material that is more rigid and significantly more resistant to deformation than the material of jamb liners 20 and 21. An extrusion of a metal containing aluminum is preferred for forming braces 30, which can be cut off at suitable lengths from an indefinitely long extrusion. This also keeps the costs low for braces 30, which can be inexpensively extruded to match a rear or frame side profile of the jamb liners.

Brace 30 includes a pair of channels 34 and 35 configured to fit around both side and rear walls of shoe channels 24 and 25. More specifically, the brace channels 34 and 35 have outside walls 36 engaging outside walls 46 of the shoe channels and inside walls 37 engaging inside walls 47 of the shoe channels. Brace channel bottoms 38 engage corresponding shoe channel bottoms 48 so that brace channels 34 and 35 receive and fit around three walls of the respective shoe channels 24 and 25 on a frame side of each jamb liner 20 and 21. A connecting web 33 extends between brace channels 34 and 35 and spans or bridges a parting bead region 28 of each jamb liner.

Fins 45 are formed on outside shoe channel walls 46 where they are disposed opposite opposing fins 44. Fins 44 and 45 are used by some window manufacturers to retain sealing or resilient material within the frame side profile of jamb liner 20 for sealing or trim purposes. Brace 30 takes advantage of the presence of fins 45 for latching or attaching brace 30 to a rear face of a jamb liner by forming fin-receiving grooves 32 in brace channel walls 36. This allows a brace to be pressed into engagement with a rear face of a jamb liner until fins 45 snap into grooves 32, which then retains brace 30 in a mounted position. Fins 45 and grooves 32 can also be added to jamb liner walls 47 and brace walls 37 to make the retention of brace 30 on jamb liner 20 more secure. Other interlocks or mounting means can also be arranged to attach braces 30 to the frame sides of jamb liners 20 and 21.

Resilient foam material 50, which is popular for giving jamb liners 20 and 21 the necessary resilient bias toward the stiles of tilt sash 12 and 13, can extend between braces 30 and frame 11. This is preferably accomplished by eliminating adhesive for resilient material 50 in the region where braces 30 are attached and then severing material 50 to allow braces 30 to be mounted to the jamb liners in positions where they can be covered over by material 50. Resilient material 50 is more compressed in regions between frame 11 and braces 30 than in regions between frame 11 and jamb liners 20 and 21 where braces 30 are not present. This is not a disadvantage, though, because it helps stiffen the jamb liners in the vulnerable regions where braces 30 are attached.

Braces 30 are preferably attached to jamb liners 20 and 21 at check rail region 15 where window 10 is weakest in wind resistance. Braces 30 can extend to various distances above and below check rail region 15, subject to the expense of the brace material required. Braces 30 can also be applied at a bottom region of window 10 just above window sill 18, where lower sash 13 is vulnerable to negative wind force.

Wind force applied to tilt sash 12 and 13 and transmitted to jamb liners 21 and 22 can have at least two effects. One is to bow the jamb liners inward or outward in respective response to positive and negative wind force. In these directions, jamb liners 20 and 21 are confined between interior and exterior trim strips, which limit the bowing motion of the jamb liners. The wind force in bowing the jamb liners can also make them collapse in a way that reduces their undeformed width. Braces 30 help jamb liners 20 and 21 resist any such collapse and limit the bowing of jamb liners to the space available between interior and exterior trim strips.

Wind force applied to sash shoes 26 via sash pins 27 can also deform shoe channels 24 and 25, allowing shoes 26 to twist within their channels. Any such twisting can allow sash pins 27 to escape from shoes 26, releasing a sash to the wind force, which instantly shatters the window. Braces 30, by engaging and holding the frame side walls of shoe channels 24 and 25, resist such deformation and keep shoes 26 from twisting within their shoe channels. This keeps sash pins 27 within shoes 26 to increase the wind resistance of window 10.

I claim:

1. A brace combined with an extruded resin jamb liner of a window, the jamb liner including an integral pair of shoe channels in which respective tilt sash shoes run vertically and connect to respective tilt sash via sash pins, the combination comprising:

a. the brace having a pair of parallel and spaced-apart brace channels receiving and straddling the shoe channels of the jamb liner on a frame side of the jamb liner;

b. a web of the brace extending between the brace channels on the frame side of the jamb liner to bridge a parting bead region of the jamb liner;

c. the brace being arranged at a check rail region of the window; and d. the brace channels being configured for limiting movement of the shoe channels in response to wind force applied to the sash and transmitted to the shoe channels via sash pins extending from the sash into engagement with shoes in the shoe channels so that the brace increases the wind resistance of the window.

2. The combination of claim 1 wherein the brace is formed as an extrusion of metal.

3. The combination of claim 2 wherein the metal includes aluminum.

4. The combination of claim 1 wherein another brace is arranged at a bottom region of the window.

5. The combination of claim 1 including a groove arranged in each of the brace channels to interlock with a rib formed on each shoe channel of the jamb liner.

6. The combination of claim 1 wherein resilient foam material secured to the frame side of the jamb liner extends over the brace between the brace and the frame.

7. A wind-resisting window system including a tilt sash supported between a pair of resin jamb liners arranged within a frame of a window, the jamb liners have shoe channels holding tilt shoes that run vertically with the tilt sash and connect to the tilt sash via sash pins, the system comprising:

a. a pair of braces arranged between each jamb liner and the frame at a check rail region of the window;

b. each brace having a pair of brace channels straddling and engaging opposite walls of the shoe channels of the jamb liner on a frame side of the jamb liner; and c. each pair of brace channels being interconnected to hold the shoe channels against movement in response to wind force transmitted to the shoe channels via the tilt shoes engaging the sash pins of the tilt sash so that the braces strengthen wind resistance of the window.

8. The system of claim 7 including an additional pair of the braces arranged at a bottom region of the window.

9. The system of claim 7 wherein each of the brace channels has a groove configured to engage a rib extending outward from each shoe channel of the jamb liner to interlock the brace and the jamb liner.

10. The system of claim 7 wherein the braces are extruded of metal.

11. The system of claim 7 wherein the braces have a snap fit on the jamb liner.

12. The system of claim 7 wherein each of the brace channels engages three walls of the respective shoe channels.

13. A wind resistance bracing system combined with a window having a tilt sash supported between opposite resin jamb liners arranged within a frame, the bracing system comprising:

a. an extrusion of a metallic material forming a brace having a brace profile approximately fitting a frame side profile of the jamb liners;

b. the brace profile including a pair of parallel channels straddling side walls of shoe channels of the jamb liner at the frame side of the jamb liner;

c. a web extending between the brace channels and disposed for bridging a parting bead region of the jamb liner between the shoe channels;

d. the shoe channels of the jamb liner each carrying a tilt shoe connected to the tilt sash via a sash pin; and e. the brace limiting deformation of the jamb liners in response to wind force transmitted from the tilt sash to the jamb liners via the sash pins engaging the tilt shoes in the shoe channels so that the brace system strengthens wind resistance of the window.

14. The brace system of claim 13 wherein each of the brace channels has a groove interlocking with a fin formed on a side wall of each of the shoe channels.

15. The brace system of claim 13 wherein the metallic material includes aluminum.

16. The brace system of claim 13 wherein a pair of the braces are arranged between the jamb liners and the frame at a check rail region of the window.

17. The brace system of claim 13 wherein a pair of the braces are arranged between the jamb liners and the frame at a bottom region of the window.

18. The brace system of claim 13 including resilient foam material extending between the jamb liners and the frame and between a pair of the braces and the frame.

19. A wind resistance bracing system combined with jamb liners supporting a tilt sash within a window frame, the bracing system comprising:

a. a pair of braces formed of material that is significantly more resistant to deformation than an extruded resin material forming the jamb liners;

b. the braces being configured to engage a rear profile of each jamb liner between each jamb liner and the frame;

c. the engagement of the braces with the rear profile of the jamb liners including engagement of opposite sides of each of a pair of shoe channels formed in the jamb liner; and d. the engagement of the braces with opposite sides of the shoe channels limiting deformation of the shoe channels in response to wind force transmitted from the tilt sash via sash pins to tilt shoes housed for vertical motion within the shoe channels.

20. The bracing system of claim 19 wherein a resilient material arranged on the frame side of the jamb liners extends between the braces and the frame.

21. The bracing system of claim 19 including grooves in the braces engaging fins extending from side walls of the shoe channels.

22. The bracing system of claim 19 wherein the braces are arranged at a check rail region of the window.

23. The bracing system of claim 19 wherein the braces are arranged at a bottom region of the window.

24. The bracing system of claim 19 wherein the braces are extruded of metal.

25. A wind resistance bracing system combined with jamb liners supporting a tilt sash within a window frame, the bracing system comprising:

a. a pair of braces formed of material that is more rigid than extruded resin material forming the jamb liners;

b. the braces being configured to engage a portion of a rear profile of each jamb liner between each jamb liner and the frame; and c. the braces being attached to the jamb liners at a check rail region of the window to receive and straddle shoe channels of the jamb liners so as to limit deformation of the jamb liners in response to wind force transmitted from the tilt sash to the jamb liners via sash pins engaging tilt shoes arranged for vertical movement within the shoe channels.

26. The bracing system of claim 25 wherein the braces are extruded of metal.

27. The bracing system of claim 25 wherein a resilient material extending between the jamb liners and the frame also extends between the braces and the frame.

28. The bracing system of claim 25 wherein the braces attach to the jamb liners by interlocking with ribs extending from the shoe channels of the jamb liners.

29. The bracing system of claim 25 including a pair of the braces arranged at a bottom region of the window.

30. In a window supporting a tilt sash between a pair of extruded resin jamb liners within a frame, the improvement comprising:

a. a pair of braces arranged respectively between the jamb liners and the frame at a check rail region of the window;

b. each of the braces engaging a rear profile of each jamb liner without being fastened to the frame; and c. the engagement of the braces with the rear profiles of the jamb liners being configured to hold shoe channels of the jamb liners against deformation in response to wind force applied to the tilt sash and transmitted to the jamb liners via sash pins engaging tilt shoes that are vertically movable within the shoe channels engaged by the braces.

31. The improvement of claim 30 wherein the braces engage frame side surfaces of shoe channels of the jamb liners.

32. The improvement of claim 30 wherein the braces have rib and groove interlocks with the jamb liners.

33. The improvement of claim 30 wherein the braces are extruded.

34. The improvement of claim 33 wherein the braces are extruded of metal including aluminum.

35. The improvement of claim 30 including a pair of the braces arranged at a bottom region of the window.

* * * * *